United States Patent [19]

Blanc

[11] 4,313,811

[45] Feb. 2, 1982

[54] ARRANGEMENT OF BUSBARS FOR ELECTROLYTIC CELLS

[75] Inventor: Jean M. Blanc, Sierre, Switzerland

[73] Assignee: Swiss Aluminium Ltd., Chippis, Switzerland

[21] Appl. No.: 205,735

[22] Filed: Nov. 10, 1980

[30] Foreign Application Priority Data

Jun. 23, 1980 [CH] Switzerland ..... 4786/80

[51] Int. Cl.[3] ..... C25C 3/16

[52] U.S. Cl. ..... 204/243 M; 204/244

[58] Field of Search ..... 204/243 M, 244, 67, 204/245-247

[56] References Cited

U.S. PATENT DOCUMENTS

| | | | |
|---|---|---|---|
| 3,415,724 | 12/1968 | Heaton et al. | 204/67 |
| 3,969,213 | 7/1976 | Yamamoto et al. | 204/243 M |
| 4,049,528 | 9/1977 | Morel et al. | 204/243 M X |
| 4,090,930 | 5/1978 | Morel et al. | 204/243 M X |
| 4,194,958 | 3/1980 | Nebell | 204/243 M |
| 4,250,012 | 2/1981 | Kaluzhsky et al. | 204/243 M |

FOREIGN PATENT DOCUMENTS

| | | | |
|---|---|---|---|
| WO 80/01698 | 8/1980 | Int'l Appl. | 204/243 M |

*Primary Examiner*—Delbert E. Gantz
*Assistant Examiner*—Donald R. Valentine
*Attorney, Agent, or Firm*—Bachman and LaPointe

[57] ABSTRACT

The direct electric current from a transversely disposed electrolytic cell, in particular a cell for producing aluminum, is partly conducted under the cell before being led to the anode beam of the next cell. The aluminum busbars connected to the cathode bar ends which are upstream with respect to the general direction of current flow I are led alternately, individually under the cell and collectively around the cell. On the long side of the cell, downstream with respect to direction I, the busbars which have been led individually under the cell are usefully brought together to collector bars; these are led to the anode beam of the next cell preferably together with busbars which are led around the cell and/or the busbars connected to the downstream cathode bar ends, all of which also join up with the collector bars.

13 Claims, 5 Drawing Figures

ARRANGEMENT OF BUSBARS FOR ELECTROLYTIC CELLS

BACKGROUND OF THE INVENTION

The invention relates to an arrangement of busbars for conducting the direct electric current from the ends of the cathode bars of a transversely disposed electrolytic cell, in particular a cell for producing aluminum, to the anode beam of the following cell whereby some of the busbars are positioned under the cell.

In order to produce aluminum by the electrolysis of aluminum oxide, the aluminum oxide is dissolved in a fluoride melt which is made up for the most part of cryolite. The cathodically deposited aluminum collects under the fluoride melt on the carbon floor of the cell where the surface of the liquid aluminum forms the cathode. Dipping into the melt from above are anodes which in conventional processes are made of amorphous carbon. The anodes are secured to an overhead anode beam. As a result of the electrolytic decomposition of the aluminum oxide, oxygen is formed at the carbon anodes and combines with the carbon to form $CO_2$ and CO. The electrolytic process takes place in general at a temperature of about 940°–970° C. During the process, the electrolyte becomes depleted in aluminum oxide. When this substance reaches a lower concentration of 1–2 wt.%, an anode effect occurs which causes an increase in voltage from, for example, 4–5 V. to 30 V and more. At this time the solidified crust of electrolyte on the surface must be broken open and the concentration of aluminum oxide increased by adding fresh aluminum oxide (alumina).

Embedded in the carbon floor of the cell are cathode bars, the ends of which project through the sides of the tank of the cell. These iron bars collect the electrolyzing current which flows via the busbars outside the cell through the risers, the anode beam and the anode rods to the carbon anodes of the next cell. An energy loss of the order of up to 1 kWh/kg of aluminum produced is experienced in passing current from the cathode bars to the anodes of the next cell as a result of ohmic resistance. Repeated attempts have been made to optimize the arrangement of the busbars with respect to ohmic resistance. In doing so, however, the vertical components of induced magnetic fields must be taken into account; together with the horizontal components of current density, these produce a significant magnetic field in the liquid metal produced in the reduction process.

The passage of current from cell to cell in an aluminum smelter with transversely arranged reduction cells is as follows: The direct electric current is collected by the cathode bars embedded in the carbon floor of the cell and leaves, with respect to the general direction of current flow, via the upstream and downstream ends. The iron cathode bars are connected via flexible strips to aluminum busbars. The busbars which, if desired, may be in the form of collector bars, conduct the direct current to the vicinity of the next cell where the current is led via other flexible strips and risers to the anode beam supporting the anodes. The risers are, depending on the type of cell, connected electrically to the end and/or a longitudinal face of the anode beam.

These characteristic arrangements for conducting the electrolyzing current in aluminum smelters suffer, however, from difficulties both of electrical and magnetic nature; efforts to overcome these have been reported in many publications.

In the British patent GB No. 1 032 810 an invention which concerns the hooding of the cell discloses that the busbars can be arranged below the electrolytic cell. The electric current is fed from the long side of the cell, symmetrically into the anode beam of the next cell. According to FIG. 2 of the patent conductors 135 are made to pass symmetrically under the cell with respect to the transverse direction of the cell.

According to the U.S. Pat. No. 3,415,724 an arrangement of busbars is aimed at, by means of which the magnetic effects are not increased when the current is increased. To this end, a part of the current emerging from the cathode bar ends at the upstream end—but less than half of the current, is led under the cell. The rest of the current leaving the cathode bar ends at the upstream end is led, in a concentrated manner around the end of the cell. According to FIG. 3 of the patent the conductors which carry the current under the cell are positioned in the middle of the cell and are shown as collector bars. The feeding of current into the anode beam of the next cell takes place, with respect to the transverse axis of the cell, symmetrically at four places on the long sides of the anode beam.

The process disclosed in the German Auslegeschrift No. 26 13 867 shows an arrangement of busbars according to which a part of the current leaving the cathode bars in the upstream direction, is fed via two busbars in the middle of the cell, under the cell and into the side of the anode beam of the next cell. The rest of the current emerging upstream is carried around the cell and fed into the end face of the anode beam of the next cell (FIG. 3) of the patent. The current flowing out of the cathode bars at the downstream end is led to the other branch of the anode beam of the next cell and fed in at the side.

The arrangement shown in the German patent application No. 28 45 614 to compensate for harmful magnetic effects comprises three collector busbars running under the cell. The current is fed via risers into the side of the anode beam of the next cell. This manner of feeding is however asymmetric as a small amount of current is led around that short side of the cell which faces the magnetically dominating, neighboring row of cells. The publications representing the state of the art or the devices described in them, where some proportion of the busbars are positioned under the cells, have the disadvantage that the magnetic and electrical difficulties cannot be overcome in an optimal fashion.

It is therefore a principal object of the present invention to provide an arrangement of busbars for transversely disposed electrolytic cells, whereby negligible magnetic and electrical effects are produced at low investment costs and with good electrical efficiency.

SUMMARY OF THE INVENTION

The foregoing object is achieved by way of the present invention wherein busbars connected to the cathode bar ends at the upstream end are arranged alternately, individually under the cell and collectively around the cell.

The busbars connected to the upstream cathode bar ends can be led grouped together under the cell or around the cell. In doing so, it is important that the groups led under the cell and those led round the cell alternate, and that each busbar which is connected with an upstream cathode bar end and is not led round the cell, is led individually under the cell.

If, for example, three consecutive busbars connected to the upstream cathode bar ends form a group of three passing under the cell, then the next three, likewise upstream, cathode bar ends are grouped together and led collectively in one busbar around the cell. The next group of three busbars connected to upstream cathode bar ends is again led individually under the cell, and so on.

The number of busbars forming a group is limited to five. On the other hand, the number of busbars forming a group can be reduced to one whereby it is then no longer actually groups of busbars but individual busbars which alternate. In this last mentioned case the busbars alternately pass under the cell and round the cell.

If two to five busbars make up the alternating groups, the number of busbars in each group is preferably equal. In other words this means that it is preferred to lead about a quarter of the busbars connected to the cathode bar ends under the cell. The word "about" must be added here because the number of cathode bar ends is always an even number but need not always be a multiple of four. When the busbars connected with the upstream cathode bar ends are led alternately under and around the cell this condition is met anyway.

At the downstream side of the cell the busbars which have been led individually under the cell are joined to collector bars. Joining up with these collector bars are the busbars which have been led around the cell and/or the busbars which are connected to the downstream cathode bar ends. The collector bars then lead to the anode beam of the next cell.

With larger cells all the busbars connected to one cathode bar end can be gathered together into four collector bars. These become risers and are connected electrically to the nearer long side or with at least one end face of the anode beam of the following cells. In principle the arrangement of the busbars can be symmetrical or asymmetrical.

With a symmetrical arrangement of the busbars the same number of busbars connected to one cathode bar end join up to all, with respect to the transverse axis of the cell, symmetrical collector bars. The collector bars are, with respect to the transverse axis of the cell, connected symmetrically to the nearer long side or both end faces of the anode beam. The places on the anode beam of the following cell where the collector bars connect up with the anode beam are preferably spaced equal distances apart.

An asymmetric supply of current can be achieved basically as follows:

The rising electrical conductors nearest the magnetically dominating, neighboring row of cells are connected to the end face of the anode beam of the following cell while the other risers join up to the nearer long side of the anode beam of the following cell. The distances between the connections the risers make with the anode beam of the following cell are preferably approximately equal.

More busbars connected to a cathode bar end join up with the collector bar/bars nearest the magnetically dominating neighboring cell than in the collector bar/-bars further removed from the neighboring row of cells.

Besides these two most important arrangement, however, an asymmetric supply of current can also be achieved for example by having collector busbars of different size in cross section leading to the anode beam of the next cell and/or collector busbars of materials with different electrical conductivities. Further, the cathode bar ends can be of different lengths.

BRIEF DESCRIPTION OF THE DRAWING

The present invention will be explained in detailed with the help of the following schematic drawings wherein.

DETAILED DESCRIPTION

Figure 1:
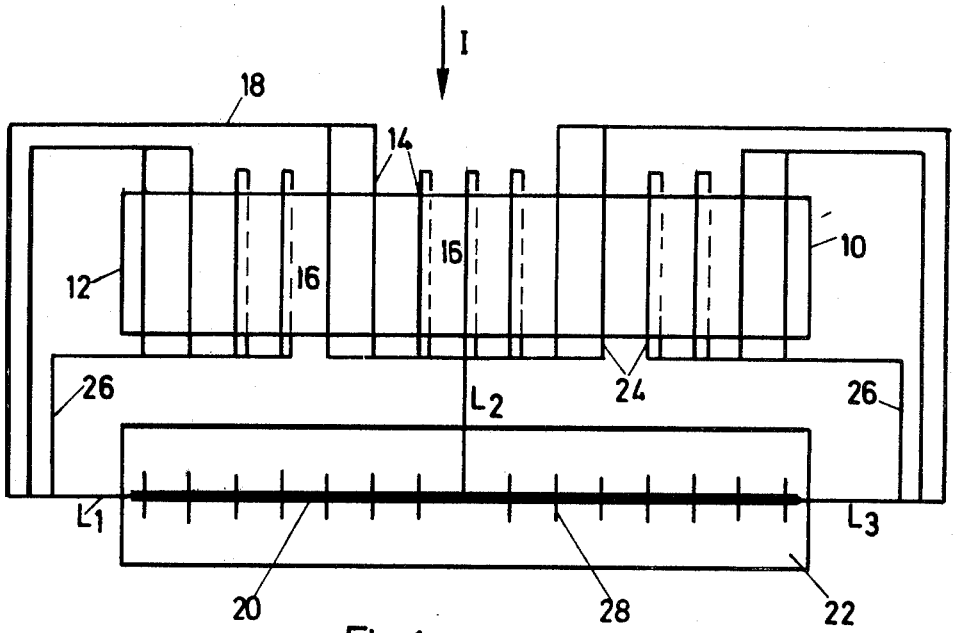
FIG. 1: Is an electrolytic cell with a symmetric arrangement of conductor bars leading to the anode beam of the following cell.

As shown in FIG. 1, there are fifteen cathode bars 12 embedded in the floor of the electrolytic cell 10. The direct electric current is drawn from the, with respect to the general direction I of current flow, upstream cathode bar ends 14 as follows:

In the center of the cell three aluminum busbars 16 conduct the current from the three middle cathode bar ends under the cell 10.

The next pair of cathode bar ends are connected to a collector bar 18 which leads the current around the cell to the anode beam 20 of the next cell.

The current from the next pair of cathode bar ends is, as with the middle three cathode bars, led individually by busbars 16 under the cell.

Finally, the outer pair of cathode bar ends are again connected to a collector bar 18 leading to the anode beam 20 of the next cell in the series.

The conductor bars are arranged therefore in groups of two which alternate in passing under the cell individually or passing grouped together around the cell.

The cathode bar ends 24 situated downstream—with respect to the general direction I of current flow—are connected to collector bars, whereby the outer collector bars 26 join up with the busbars 18 which have been led around the cell and are led on to the end faces of the anode beam via risers $L_1$ and $L_3$. The middle collector bar joining up with the riser $L_2$ is connected to the middle of the anode beam 20 on the side facing the cell 10.

The anode pairs 28 are indicated in the region of the anode beam 20.

The arrangement of the conductor bars in FIG. 1 is absolutely symmetrical with respect to the transverse axis of the cell.

Figure 2:
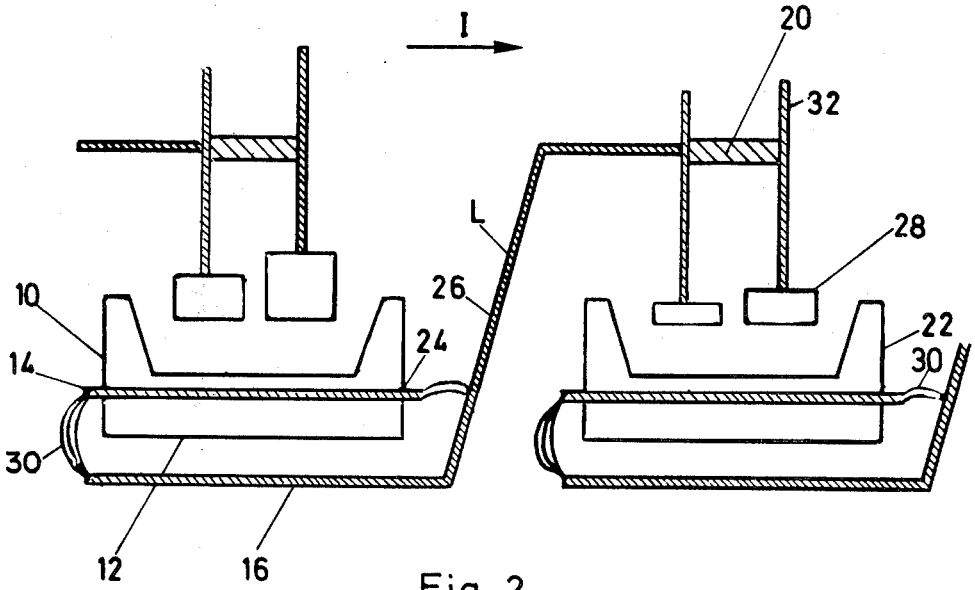
FIG. 2: Is a vertical cross section of two neighboring electrolytic cells.

In the vertical section shown in FIG. 2 it can be seen how the electrical current at the upstream end 14 of the iron cathode bars 12 is led via flexible conductors 30 to the aluminum busbars 16 leading under the cell and then again via flexible conductors 30 to the collector bar 26. The collector bar 26 becomes a riser L which leads the current to the anode beam of the next cell 22 in the series. The anodes 28 are suspended from this beam by means of anode rods 32.

Figure 3:
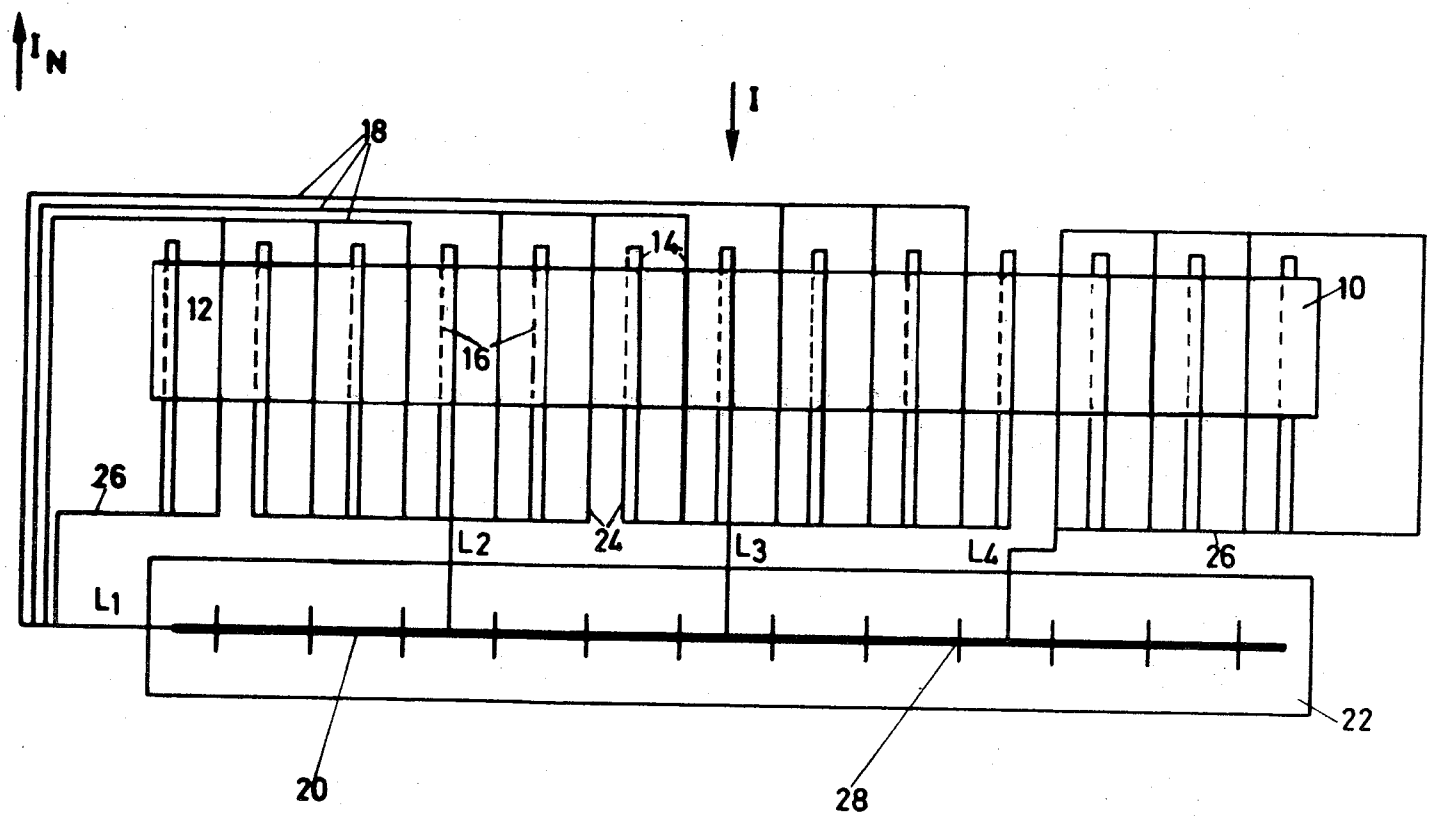
FIG. 3: Is an electrolytic cell with an asymmetric arrangement of conductor bars leading to the anode beam of the following cell and with current being fed in at one end face of the anode beam.

The electrolytic cell 10 in FIG. 3 which, with respect to the general direction of flow I, is transversely disposed, has twenty five cathode bars 12 or twenty five each of upstream and downstream cathode bar ends 14, 24. The general direction of flow of electric current in the magnetically dominating neighboring row of cells, left of FIG. 3, is denoted by $I_N$.

The current from cathode bar ends 14 is led alternately by individual busbars 16 under the cell 10 or via collector bars 18 around the cell.

The arrangement of conductor bars or passage of current is asymmetrical with respect to the transverse axis of the cell in that substantially more collector bars 18 are led around the end of the cell facing the magnetically dominating row of neighboring cells, than round the opposite end of the cell. Further, the riser $L_1$ facing the magnetically dominating row of neighboring cells leads to the end face of the anode beam 20 of the next cell 22, while the other risers $L_2$, $L_3$ and $L_4$ are connected to the side of the anode beam facing cell 10. In the present case the spacing between all welded connections joining the risers to the anode beam are equal, both with respect to each other and the free end of the anode beam.

Figure 4:
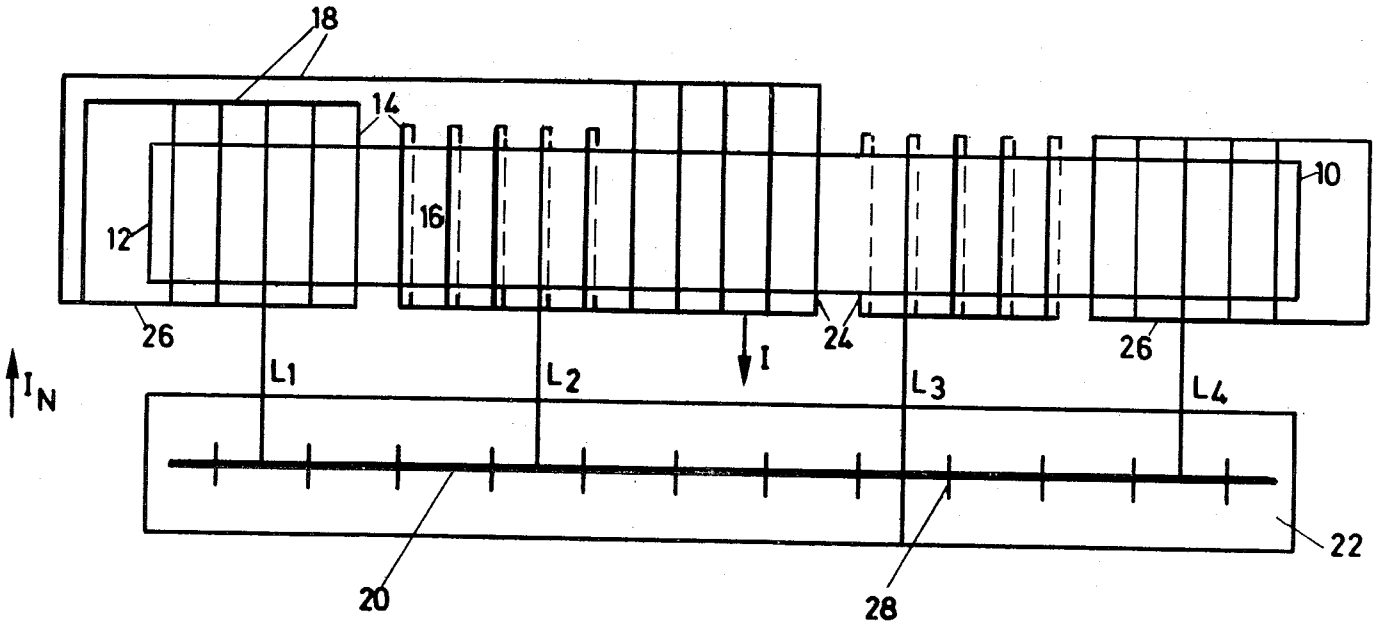
FIG. 4: Is an electrolytic cell with asymmetric supply of current to the anode beam of the next cell with the current being fed in at the sides of the anode beam.

The version of the cell shown in FIG. 4 corresponds, apart from the arrangement of the conductor bars, to that in FIG. 3. Here, however, the busbars 16, 18 connected to the upstream ends 14 of the cathode bars are taken in groups of five and either led individually under the cell or in groups around the cell. Furthermore, the arrangement of the bars is asymmetric as the collector bars 18 conduct the current from ten cathode bar ends 14 around the end of the cell facing the magnetically dominating row of cells, and at the other end only that from five cathode bar ends 14, and also because the risers $L_1$ and $L_2$ each lead the current from fifteen cathode bar ends to the nearer side of the anode beam; the risers $L_3$ and $L_4$ on the other hand each lead the current from only ten cathode bar ends. Finally, the distance between $L_1$ and $L_2$ and between $L_3$ and $L_4$ is smaller than the distance between $L_2$ and $L_3$.

Figure 5:
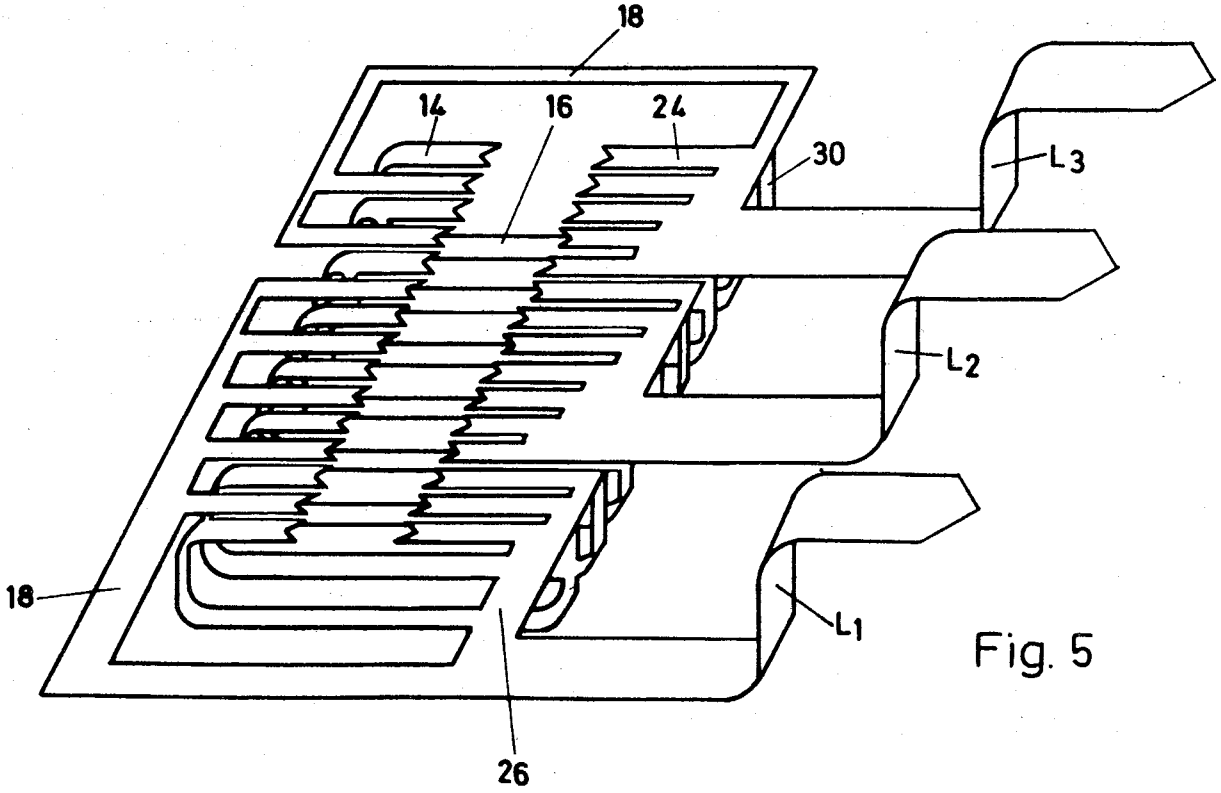
FIG. 5: Is a schematic representation of an asymmetric arrangement of the conductor bars.

FIG. 5 shows a stylized schematic representation of the isolated conductor bars. The current flows from the upstream cathode bar ends 14 alternately via bars 16 below the cell and via collector bars 18 around the cell. The collector bars 18 running round the cell, the flexible strips 30 drawing the current from bars 16 and bars 26 drawing current from the downstream cathode bar ends join up to make three large conductor bars which become risers $L_1$, $L_2$ and $L_3$ and lead the current to the anode beam of the next cell in the series. As can be seen clearly from FIG. 5, this arrangement is asymmetrical.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. In a series of electrolytic cells provided with a plurality of cathode bars an arrangement of a plurality of busbars for conducting the direct current from the cathode bar ends of a transversely disposed cell to the anode beam of the next cell in the series wherein a portion of said plurality of busbars pass under the cell the improvement which comprises connecting the cathode bar ends which lie upstream of the current flow in the cell to said plurality of busbars and alternately passing said plurality of busbars under the cell and around the cell.

2. An arrangement of busbars according to claim 1 wherein the busbars which pass under the cell are individual conductor bars and the busbars which pass around the cells are in groups.

3. An arrangement of busbars according to claim 2 wherein the groups consist of at most 5 busbars.

4. An arrangement of busbars according to claim 1 wherein the number of busbars passing under the cell corresponds to about one-quarter of the total number of cathode bar ends.

5. An arrangement of busbars according to claim 1 wherein alternately one busbar connected to the upstream cathode bar ends is passed under the cell and around the cell.

6. An arrangement of busbars according to claim 1 wherein the busbars passing under the cell are gathered together into a collector bar on the downstream side of the cell and are joined with the busbars passed around the cell.

7. An arrangement of busbars according to claim 6 wherein the collector bar is connected to the anode beam of the next cell in the series.

8. An arrangement of busbars according to claim 7 wherein all the busbars connected to a cathode bar end are connected to from about 3 to 6 collector bars which become risers and are connected electrically to the nearer long side of the anode beam of the next cell.

9. An arrangement of busbars according to claim 8 wherein said number of collector bars is preferably 4.

10. An arrangement of busbars according to claim 7 wherein the same number of cathode bars connected to one of the set of cathode bar ends join up with each of the collector bars not lying on the transverse axis, and the risers are joined symmetrically with respect to the transverse axis of the cell to the nearer long side or the two end faces of the anode beam.

11. An arrangement of busbars according to claim 8 wherein the riser lying nearest the magnetically dominating neighboring row of cells is connected to the end face anode beam of the next cell, while the other risers join up with the nearer long side of the anode beam.

12. An arrangement of busbars according to claim 11 wherein the distance between the connections the risers make with the anode beam of the next cell are approximately equal.

13. An arrangement of busbars according to claim 8 wherein the risers positioned nearest the magnetically dominating neighboring row of cells are made up of more busbars connected to one cathode bar end than the risers remote from the neighboring row of cells.

* * * * *